US005369860A

United States Patent [19]

Gabalda et al.

[11] Patent Number: 5,369,860

[45] Date of Patent: Dec. 6, 1994

[54] METHOD OF CONTROLLING THE TEMPERATURE PREVAILING INSIDE AN OVEN INTENDED FOR HEATING A YARN IN MOTION

[75] Inventors: Carlos M. Gabalda, Granges les Valence; Pierre Mirabel, Roanne, both of France

[73] Assignee: ICBT Roanne, France

[21] Appl. No.: 83,345

[22] Filed: Jun. 28, 1993

[30] Foreign Application Priority Data

Jul. 8, 1992 [FR] France ..... 92 08692

[51] Int. Cl.[5] ..... D02G 1/00; D02J 1/00; F26B 19/00

[52] U.S. Cl. ..... 28/248; 34/549

[58] Field of Search ..... 28/248, 249, 250, 247, 28/217; 19/0.27, 66 R; 34/48

[56] References Cited

U.S. PATENT DOCUMENTS

| | | | |
|---|---|---|---|
| 4,314,878 | 2/1982 | Lee | 34/48 X |
| 5,088,168 | 2/1992 | Berger et al. | 28/248 X |
| 5,193,293 | 3/1993 | Gabalda et al. . | |

FOREIGN PATENT DOCUMENTS

| | | | |
|---|---|---|---|
| 524111 | 5/1992 | European Pat. Off. . | |
| 1117718 | 12/1954 | France . | |
| 1204634 | 4/1958 | France . | |
| 2041583 | 4/1969 | France . | |
| 2473565 | 1/1980 | France . | |
| 2619128 | 8/1987 | France . | |
| 1392158 | 4/1988 | U.S.S.R. | 28/249 |

OTHER PUBLICATIONS

J. J. Press 'Man-Made Textile Encyclopedia' 1959, Textile Book Publishers, Inc., New York, US *p. 240, lines 1-9.

*Primary Examiner*—Clifford D. Crowder
*Assistant Examiner*—John J. Calvert
*Attorney, Agent, or Firm*—Harris Beach & Wilcox

[57] ABSTRACT

Method making it possible to control the temperature prevailing inside a high-temperature oven employed for the treatment of a synthetic yarn, especially during an operation of texturing by false twisting, said method consisting, in the case of a given substance (count and chemical composition), in modifying the temperature inside the oven as a function not only of the speed of travel of said yarn, but also of its count.

It is characterized in that said temperature Θ in °C. is determined from the general formula:

$$\Theta = aV + b$$

in which:

- V is the speed of travel of the yarn inside the oven in meters per minute (m/min);
- a denotes a linear variation coefficient (or slope), itself a function of the count expressed in decitex (dtex);
- b denotes a correction factor which is a constant whose value is also determined as a function of the count of the yarn in decitex (dtex).

2 Claims, 3 Drawing Sheets

METHOD OF CONTROLLING THE TEMPERATURE PREVAILING INSIDE AN OVEN INTENDED FOR HEATING A YARN IN MOTION

BACKGROUND OF THE INVENTION

1. Field of the Invention

The present invention relates to a method which makes it possible to control optimally the temperature prevailing inside an oven when it is desired to heat a yarn in motion as, for example, during texturing operations, especially using false twisting, to which synthetic yarns are subjected.

2. Discussion of the Related Art

In the description which follows the method in accordance with the invention will be described more specifically for the control of an oven employed during an operation of texturing using false twisting of a polyamide 6.6 yarn, the type of oven controlled by virtue of the method according to the invention being an oven produced in accordance with the teachings of European Patent Application No. 524,111 (corresponding to US-A-5,193,293). It is obvious that this is not a limitation and that the invention can also be applied for controlling ovens of other types and different yarns (polyamide, polyester etc.), the internal temperature of the oven then being, understandably, adapted accordingly, but the inventive concept of the present application still being applied.

In all processes for the treatment of yarns in motion requiring a heat treatment the main problem which arises is that of fast heat transfer, it being necessary for the heat to enter the yarn uniformly throughout and similarly over its whole length. In fact, as is known, the temperature of treatment and its uniformity greatly influence the properties of the yarn produced.

Furthermore, it is well known that the heat treatment varies as a function of the material being treated, of the yarn count and of its speed of travel inside the oven. It is thus easily understood that the core of a fine yarn will be reached more quickly than that of one with a high count. Similarly, it is known that a yarn cannot be heated beyond some ceiling temperature, lest it be degraded.

Since the beginning of texturing, which now goes back nearly 50 years, very many solutions have been envisaged by people skilled in the art in order to produce ovens consuming as little energy as possible and permitting operation at increasingly high speeds (to give an idea, in the 1950s the production speeds were of the order of a few tens of meters per minute, whereas nowadays they reach a thousand meters per minute or even more). All these solutions consist in applying one of the three main principles of heat exchange, namely convection, radiation, conduction or their combination.

Nowadays, industrial texturing machines generally comprise ovens in which the heating of the yarn in motion is obtained by means of a heating liquid which, on vaporizing, transmits its heat to a body (plate) with which the fluid is directly in contact (see especially French Patent 2,619,128 or 2,473,565).

Since such a solution - which, from a technical standpoint, is satisfactory and results in yarns of good quality - entails the construction of increasingly longer ovens (nowadays they reach approximately two meters with processing speeds of the order of 800 m/min), people skilled in the art have concentrated on very old proposals, consisting in maintaining inside the oven a temperature which is clearly higher than the melting point of the substance of which the yarns are made, the latter traveling inside said ovens so that they reach an equilibrium temperature which makes it possible to carry out the treatment without, however, damaging or degrading the substance of which the yarn is made. Teachings along these lines emerge from Patents 1,204,634 and 1,117,718. However, operating in this manner, which can be defined by the expression "high-temperature treatment", presents numerous problems, especially with regard to the control, which must be carried out very precisely and must be adapted as a function of the yarns being treated. Furthermore, in such high-temperature ovens there arises the problem of keeping the yarn under specific constant tension without any vibration. These latter problems are solved satisfactorily in high-temperature ovens of the type described by the Applicant in its European Patent No. 524,111 (corresponding to US-A-5,193,293).

On the other hand, so far no proposal has been made for determining in a simple and rapid manner the precise temperature which must prevail inside such ovens to obtain an industrial output, it being absolutely necessary for the yarns to have the same characteristics not only from one machine to another, but also characteristics which are reproducible in time.

The present invention is aimed at solving such a problem.

SUMMARY OF THE INVENTION

In general, the invention relates to a method which makes it possible to control the temperature prevailing inside a high-temperature oven employed for the treatment of a synthetic yarn, especially during an operation of texturing by false twisting, said method consisting, in the case of a given substance (count and chemical composition), in modifying the temperature inside the oven as a function not only of the speed of travel of said yarn, but also of its count, said method being characterized in that said temperature Θ in °C. is determined from a general formula of the type:

$$\Theta = aV + b$$

in which:

- V is the speed of travel of the yarn inside the oven in meters per minute (m/min);
- a denotes a linear variation coefficient (or slope), itself a function of the count expressed in decitex (dtex);
- b denotes a correction factor which is a constant whose value is also determined as a function of the count of the yarn in decitex (dtex).

By way of illustration, in accordance with the invention, in the case of a yarn made of polyamide 6.6 treated inside an oven constructed in accordance with the teachings of the abovementioned European patent, which has a total length of 600 mm and in which the surface for heating by contact is 300 mm, the temperature Θ in °C. inside the oven is determined by the formula:

$$\Theta = \frac{156 \ln T - 1.13\,T - 284}{1000} V + 1.13\,T + 195$$

in which:

- T=count of the yarn in dtex

- V=speed of travel of the yarn inside the oven in meters per minute.

BRIEF DESCRIPTION OF THE DRAWING

Such a formula, characteristic of the method in accordance with the invention, has been determined by proceeding in the manner described below and which is illustrated by the attached drawing, in which.

DETAILED DESCRIPTION OF THE PREFERRED EMBODIMENT

Figure 1:
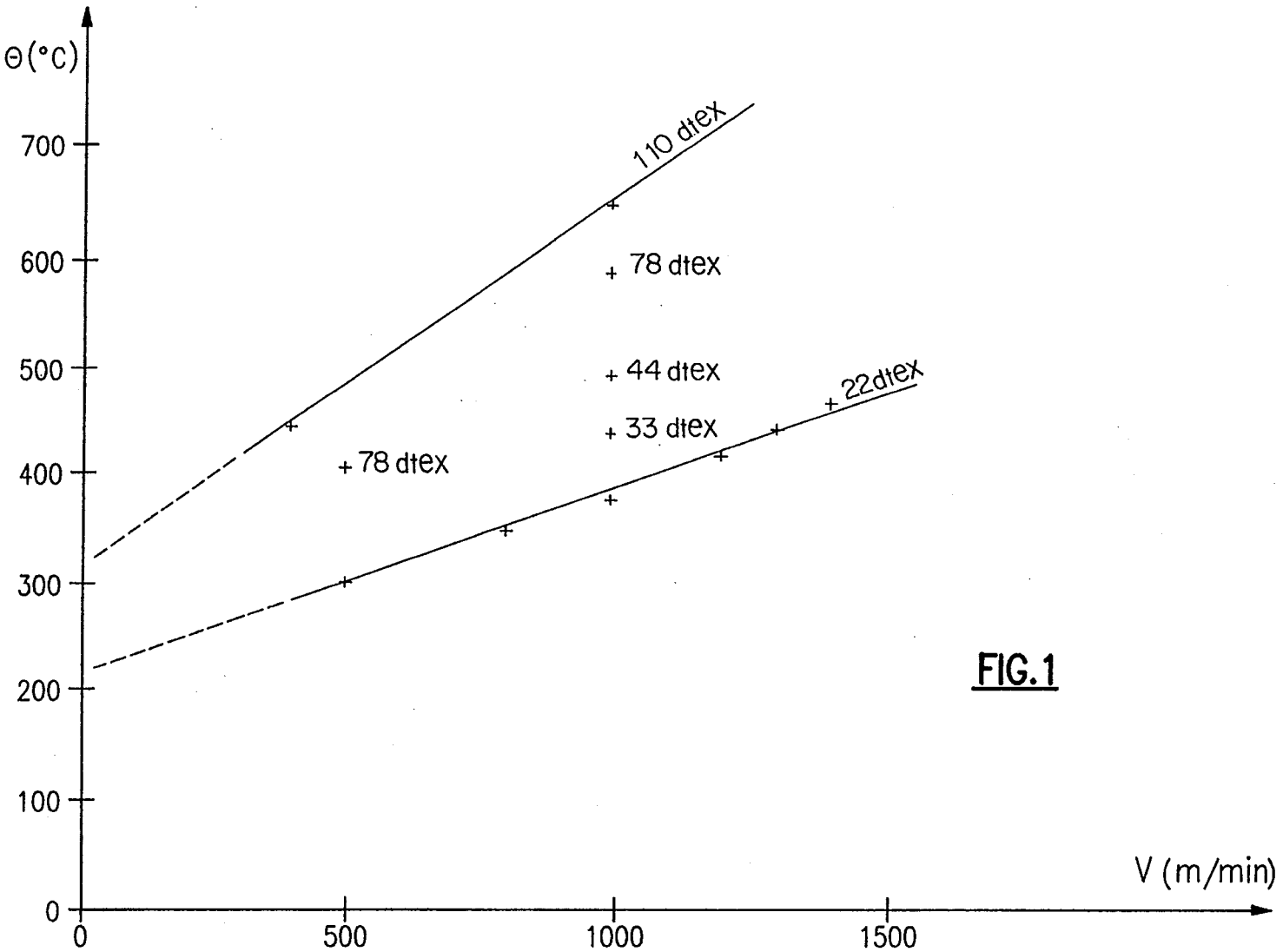
- FIG. 1 is a diagram of the temperatures inside the oven as a function of the speed of passage of yarns of different counts.
Figure 2:
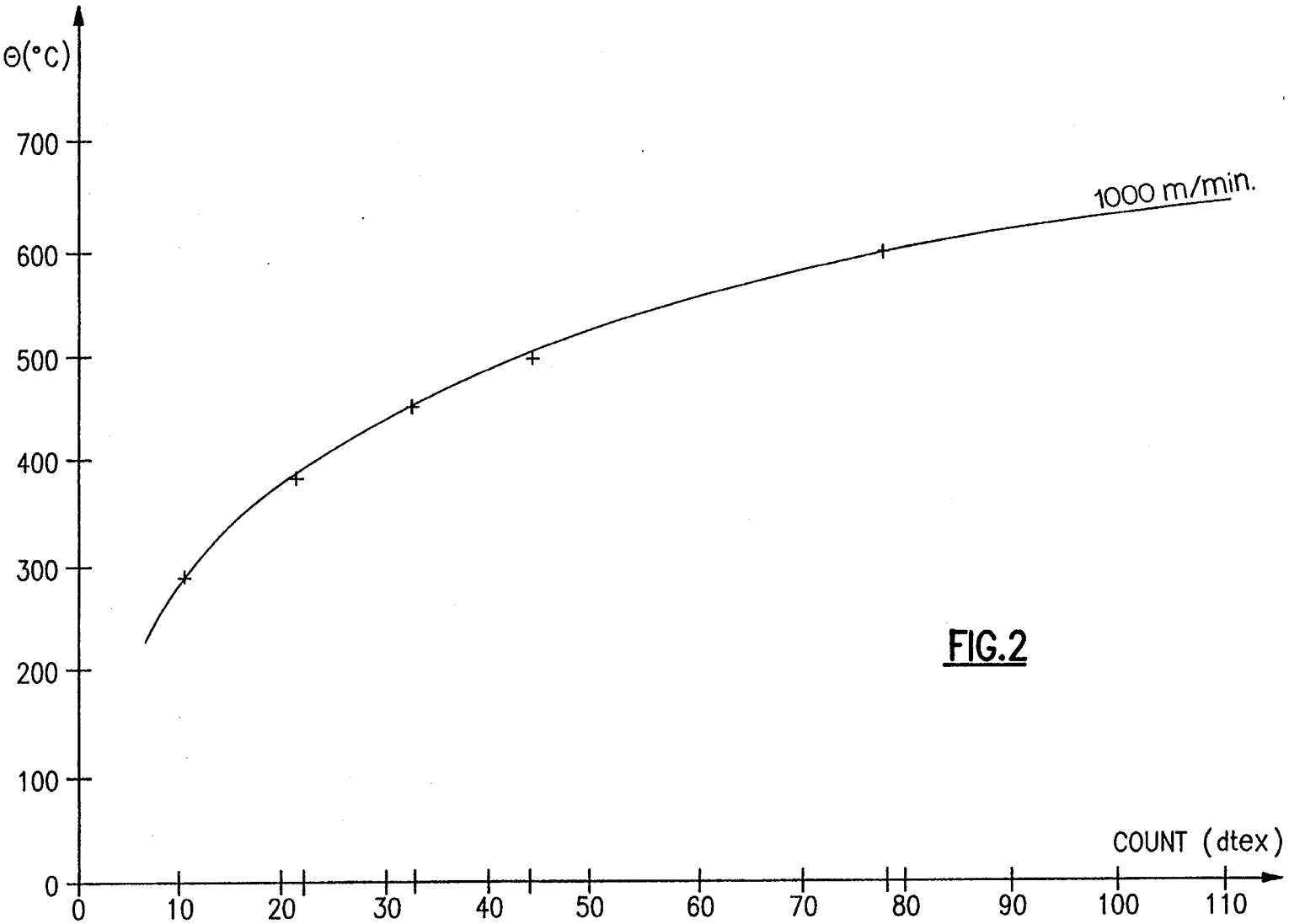
- FIG. 2 is a diagram showing the variation in temperature inside the yarn as a function of the count of the latter, at a specific speed (1000 m/min)

The curves shown in FIGS. 1 and 2 were obtained by production trials carried out successively on yarns based on polyamide 6.6 which had counts of 22, 33, 44 and 78 dtex respectively, and at 1000 m/min.

Furthermore, polyamide 6.6 yarns of 22 dtex were also tested at 500,800, 1000, 1200, 1300 and 1400 m/min.

Finally, a yarn of 110 dtex was tested at 400 m/min.

These trials, performed on yarns originating from different sources, have made it possible to verify that the yarn obtained exhibits elasticity tester values which are equal to, or even higher than, a conventional treatment (contact heating), but above all that the knits produced from such yarns have a softer feel.

From the trials carried out previously a certain number of points are available as a function of the speed and of the count.

A multiple regression curve program shows that the curve in FIG. 2 corresponds overall to:

$$\Theta = 156 \ln \text{count} - 89.$$

FIG. 1 gives a set of straight lines: $\Theta = aV + b$ which corresponds to $\Theta = 1000\ a + b$ when V equals 1000 m/min.

That is, a system:

$$\Theta = 156 \ln \text{count} - 89$$

$$\Theta = 1000\, a + b$$

$$156 \ln \text{count} - 89 = 1000a + b$$

$$a = \frac{156 \ln \text{count} - 89 - b}{1000}$$

The curves in FIG. 1 are therefore of the form:

$$\Theta = aV + b$$

$$\Theta = \frac{(156 \ln \text{count} - 89 - b)}{1000} V + b$$

From this formula it is possible to determine b:
Count=110 dtex b=320 when V=0
Count=22 dtex b=220 when V=0
The linear regression gives us T=0.88 b−171.6 that is:

$$b = \frac{T + 171.6}{0.88}$$

which gives b=1.13 T+195 resulting in:

$$\Theta = \frac{156 \ln T - 89 - 1.13\, T - 195}{1000} v + 1.13\, T + 195$$

which results in the formula:

$$\Theta = \frac{156 \ln T - 1.13\, T - 284}{1000} V + 1.13\, T + 195$$

Checks performed on yarns of different types, on the one hand by applying the formula found, on the other hand by performing a verification on the curves determined by experimenting, have all led to the results assembled in the table below.

| COUNT | SPEED | Θ CALC. | Θ CURVE | ERROR |
|---|---|---|---|---|
| 22 dtex | 1000 m/min | 393° C. | 385° C. | +2% |
| 22 dtex | 500 m/min | 306° C. | 295° C. | +3% |
| 110 dtex | 1000 m/min | 644° C. | 650° C. | −1% |
| 110 dtex | 400 m/min | 449° C. | 450° C. | −0.2% |
| 78 dtex | 500 m/min | 436° C. | 420° C. | +3.8% |
| 22 dtex | 1400 m/min | 462° C. | 470° C. | −1.7% |

From this table it is found that the errors are wholly acceptable, bearing in mind that the textile performance is comparable within a range of +5%.

Consequently, by virtue of the method in accordance with the invention it is possible to target the suitable temperatures more quickly when it is desired to carry out tests, and to establish charts which can be employed in industrial production.

Figure 3:
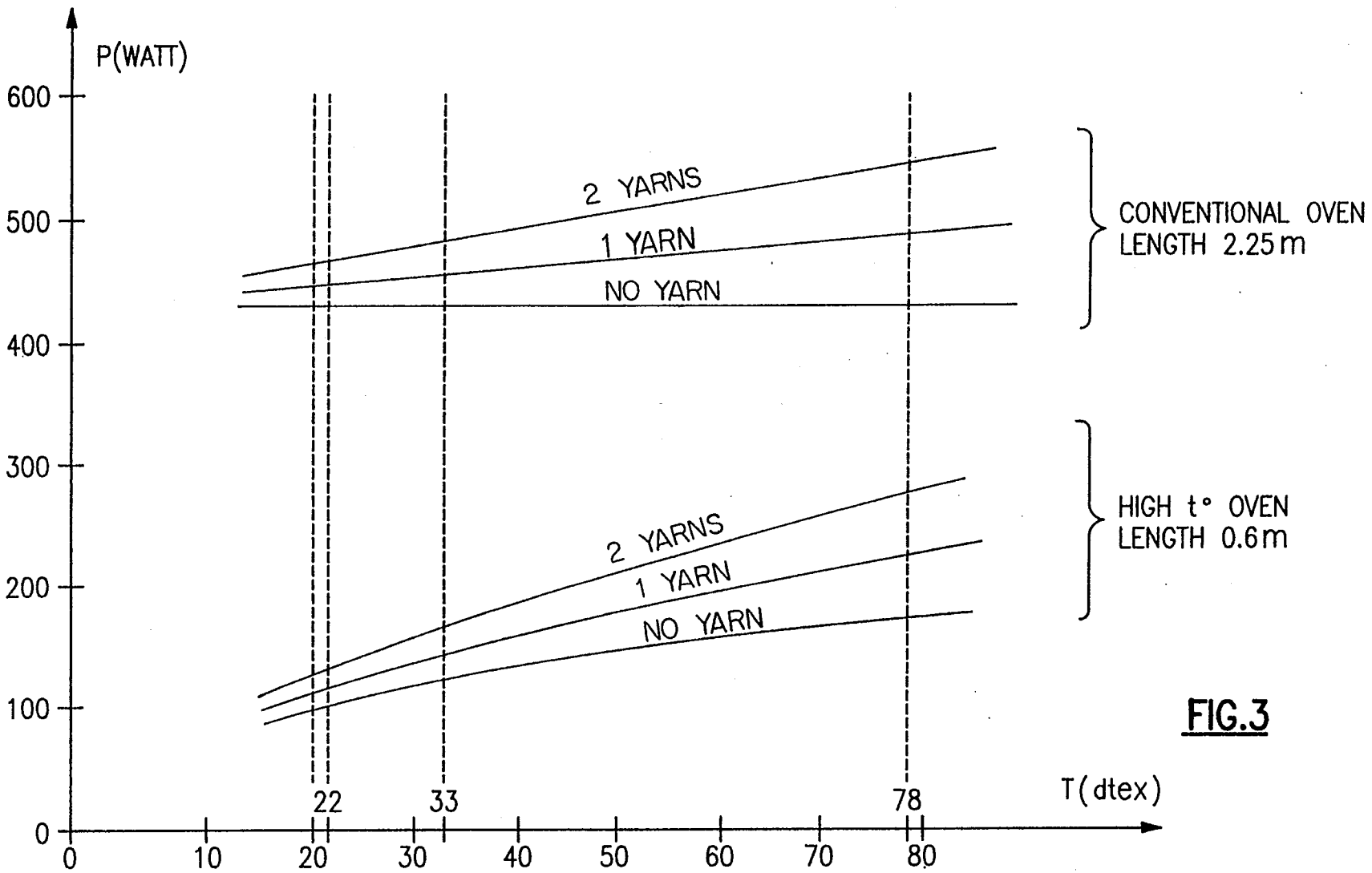
- FIG. 3 is a diagram comparing the power consumptions for an oven operating in accordance with the method of the invention and an oven using conventional contact.

Furthermore, it is appropriate to note that, by treating yarns at high temperature in accordance with the invention, a not insignificant saving in power consumption is obtained, as shown by the diagram in FIG. 3.

In fact, with a conventional process (contact heating), the temperature is stationary whatever the count and the speed.

On the other hand, when working in accordance with the invention and when the temperature is varied as a function of the count and of the speed, power fluctuations are obtained in the same proportions.

From FIG. 3, it appears that, in the case of a 22 dtex yarn, a ratio of 1 to 4 is obtained in favor of the high-temperature oven and that, in the case of a 78 dtex yarn, a ratio of 1 to 2 is obtained when working in conditions in accordance with the method of the invention.

Of course, the invention is not limited to the treatments of polyamide 6.6 yarns, but could also be applied to carry out the control of the temperature of an oven for yarns of other types. Thus, by way of guidance, tests carried out on polyamide 6 by applying a similar method were successfully obtained, it being understood that the temperature was lowered by a value corresponding substantially to the difference in temperature compatible with this type of substance. For example, a 44 dtex polyamide 6.6 yarn treated at 1000 m/min involves a temperature of 495° C., whereas a polyamide 6 yarn treated in accordance with the invention requires a temperature of the order of 410° C.

We claim:

1. A method for controlling the temperature inside a high-temperature oven employed for the treatment of yarn, said treatment including the operation of texturing by false twisting, said method comprising the steps of:

determining the count of the yarn undergoing a respective treatment, said count being expressed in decitex (dtex);

measuring the speed of travel of the yarn moving through the high-temperature oven;

calculating an operating temperature Θ in °C. for the oven based on the results obtained from said determining and measuring steps;

said operating temperature Θ being determined by the formula $$\Theta = aV + b$$

where:

V is the speed of travel of the yarn moving through the oven being expressed in meters per minute;

a is a linear variation coefficient or slope, said variable a being a function of the count of the yarn as expressed in dtex; and b is a correction factor of constant value being a function of the count of the yarn as expressed in dtex; and modifying the oven temperature so that the temperature maintained therein during said respective treatment is the temperature Θ.

2. A method for controlling the temperature inside a high-temperature oven employed for the treatment of yarn while in motion, said oven being of the type having a total length of 600 mm with a contact heating zone measuring 300 mm, and said yarn moving therethrough being a polyamide 6.6 yarn, said method comprising the steps of:

measuring the speed of travel of the yarn moving through the high-temperature oven to undergo a respective treatment therein;

calculating an operating temperature Θ in °C. for the oven based on the results obtained from said measuring step;

said operating temperature Θ being determined by the formula, $$\theta = \frac{156 \text{ Ln } T - 1.13\ T - 284}{1000} V + 1.13\ T + 195$$

where:

V is the speed of travel of the yarn moving through the oven being expressed in meters per minute; and T is the count of the yarn as expressed in decitex; and modifying the oven temperature so that the temperature maintained therein during said respective treatment is the temperature Θ.

* * * * *